US007735495B2

(12) United States Patent
Lane et al.

(10) Patent No.: US 7,735,495 B2
(45) Date of Patent: Jun. 15, 2010

(54) PARTIAL CAP HAIR ACCESSORY

(75) Inventors: Teresa Jo Lane, Hallandale Beach, FL (US); Ken Paves, Los Angeles, CA (US)

(73) Assignee: Celebrity Signatures International, Inc., Kansas City, MO (US)

( * ) Notice: Subject to any disclaimer, the term of this patent is extended or adjusted under 35 U.S.C. 154(b) by 605 days.

(21) Appl. No.: 11/670,319

(22) Filed: Feb. 1, 2007

(65) Prior Publication Data

US 2007/0221244 A1 Sep. 27, 2007

(51) Int. Cl.
*A41G 3/00* (2006.01)
*A41G 5/00* (2006.01)

(52) U.S. Cl. ..... 132/53; 132/201

(58) Field of Classification Search ..... 132/201, 132/53–56

See application file for complete search history.

(56) References Cited

U.S. PATENT DOCUMENTS

| | | | | |
|---|---|---|---|---|
| 125,382 | A | 4/1872 | Cutter | |
| 541,125 | A | 6/1895 | Simonson | |
| D059,261 | S | 10/1921 | Muller | |
| 1,424,845 | A | 8/1922 | Nolan | |
| 1,519,107 | A | 12/1924 | Breslauer | |
| 1,540,102 | A | 6/1925 | Cohen | |
| 1,549,334 | A | 8/1925 | Ruffio | |
| 1,638,016 | A | 8/1927 | Oppenheim | |
| 1,665,380 | A | 4/1928 | Ruffio | |
| 1,780,766 | A | 11/1930 | Oppenheim | |
| 2,651,310 | A | 9/1953 | Selson | |
| 2,814,301 | A | 11/1957 | Schmitz | |
| 3,280,826 | A | 10/1966 | Jenkins | |
| 3,307,563 | A | 3/1967 | Regina | |
| 3,434,481 | A | 3/1969 | Mazzocco | |
| 3,485,249 | A | 12/1969 | Mast | |
| 3,520,310 | A | 7/1970 | Witmondt | |
| 3,561,457 | A | 2/1971 | Duesel | |
| 3,659,621 | A * | 5/1972 | Tucciarone et al. | 132/53 |
| 3,683,941 | A | 8/1972 | Friedland | |
| 3,734,105 | A * | 5/1973 | Borghese | 132/53 |
| 3,777,768 | A | 12/1973 | Scigliano | |
| 3,834,403 | A | 9/1974 | Ahn | |
| 3,889,695 | A | 6/1975 | Incando | |
| 3,910,291 | A | 10/1975 | Kiim | |
| 4,168,713 | A * | 9/1979 | Agiotis | 132/53 |
| 4,509,539 | A | 4/1985 | Alfieri | |
| 4,576,189 | A | 3/1986 | Regina | |
| 4,600,029 | A | 7/1986 | Ueberschaar | |
| 4,799,502 | A | 1/1989 | Kobayashi et al. | |

(Continued)

FOREIGN PATENT DOCUMENTS

| | | |
|---|---|---|
| AU | 740896 | 11/2001 |

(Continued)

*Primary Examiner*—Robyn Doan
(74) *Attorney, Agent, or Firm*—Lathrop & Gage LLP

(57) ABSTRACT

A support structure and a hair accessory utilizing the support structure are disclosed. The support structure is configured to engage and surround substantially only a rear portion of a user's head, and according to an embodiment the support structure includes a crown segment, a central support member, a crossing member, and a plurality of side segments. The hair accessory includes a plurality of hair strand retention members attached to and extending across the support structure and a plurality of hair strands extending from each hair strand retention member.

25 Claims, 6 Drawing Sheets

U.S. PATENT DOCUMENTS

| | | | | |
|---|---|---|---|---|
| D316,161 | S | 4/1991 | Kuglen | |
| 5,271,420 | A | 12/1993 | Park | |
| D356,398 | S | 3/1995 | Hafid | |
| 5,406,971 | A | 4/1995 | Taylor | |
| 5,501,239 | A | 3/1996 | Walker | |
| 5,551,452 | A | 9/1996 | Barlow | |
| 5,657,774 | A | 8/1997 | Niese | |
| 5,690,128 | A | 11/1997 | Grimees | |
| 5,746,232 | A | 5/1998 | Martin et al. | |
| 5,787,904 | A | 8/1998 | Michaud | |
| 5,806,535 | A | 9/1998 | Becker | |
| 5,813,418 | A | 9/1998 | Pillars | |
| 5,873,373 | A | 2/1999 | Narvick | |
| 5,899,211 | A | 5/1999 | Brown | |
| 5,937,867 | A | 8/1999 | Williams | |
| 5,947,129 | A | 9/1999 | Bradshaw | |
| 5,979,462 | A | 11/1999 | Jones | |
| 5,988,177 | A | 11/1999 | Bate | |
| 6,016,814 | A | 1/2000 | Elliott | |
| 6,019,107 | A | 2/2000 | Overmyer et al. | |
| 6,035,861 | A | 3/2000 | Copello | |
| 6,047,705 | A | 4/2000 | Hawley | |
| 6,082,371 | A | 7/2000 | Bader-Saltzman et al. | |
| 6,105,584 | A | 8/2000 | Williams | |
| 6,123,086 | A | 9/2000 | Kuglen | |
| 6,135,125 | A | 10/2000 | Sartena | |
| 6,206,011 | B1 | 3/2001 | Sartena | |
| 6,247,476 | B1 | 6/2001 | Sartena | |
| D445,217 | S | 7/2001 | Vidal | |
| 6,257,250 | B1 | 7/2001 | Sartena | |
| 6,273,097 | B1 | 8/2001 | Sartena | |
| 6,298,861 | B1 | 10/2001 | Kageyama | |
| 6,302,115 | B1 | 10/2001 | Sartena | |
| 6,352,079 | B1 | 3/2002 | Bate | |
| 6,513,535 | B1 | 2/2003 | Lane | |
| 6,581,611 | B2 | 6/2003 | Sartena | |
| 6,591,843 | B1 | 7/2003 | Langohr | |
| 6,629,536 | B1 | 10/2003 | Lane | |
| 6,708,696 | B2 | 3/2004 | Ferguson | |
| 6,766,805 | B1 | 7/2004 | Cupp | |
| 6,830,054 | B1 | 12/2004 | Ross-Kuehn | |
| 6,935,349 | B2 * | 8/2005 | Nicot et al. | 132/53 |
| D510,779 | S | 10/2005 | Gladwin et al. | |
| D511,022 | S | 10/2005 | Gladwin et al. | |
| 7,150,282 | B2 | 12/2006 | Lane | |
| 7,174,899 | B2 | 2/2007 | Lane | |
| 7,222,627 | B1 * | 5/2007 | Johns | 132/54 |
| 2003/0140934 | A1 | 7/2003 | Sugai | |
| 2004/0011371 | A1 * | 1/2004 | Harrison | 132/201 |
| 2004/0103909 | A1 | 6/2004 | Silva | |
| 2004/0237987 | A1 | 12/2004 | Gold | |
| 2007/0034221 | A1 * | 2/2007 | Chung | 132/53 |

FOREIGN PATENT DOCUMENTS

| | | | |
|---|---|---|---|
| AU | 2007246332 | | 11/2007 |
| CA | 2643435 | | 11/2007 |
| CA | 2265653 | | 11/2008 |
| CN | 1234724 | | 11/1999 |
| CN | 1450867 | | 10/2003 |
| DE | 3542123 | | 4/1987 |
| DE | 69834707 | | 1/2007 |
| DK | 925731 | | 6/1999 |
| EP | 0929242 | B1 | 7/2002 |
| EP | 1275314 | | 1/2003 |
| EP | 925731 | | 7/2006 |
| ES | 2260836 | | 11/2006 |
| GB | 1035195 | | 7/1966 |
| JP | 11001811 | | 1/1999 |
| TW | 491695 | | 6/2002 |
| WO | 9854993 | | 12/1998 |
| WO | 0164065 | | 9/2001 |
| WO | 2007129708 | | 11/2007 |

* cited by examiner

PARTIAL CAP HAIR ACCESSORY

BACKGROUND

This invention relates generally to hair accessories and, more particularly, to a partial or half cap hair accessory that supplements the natural hair of a user.

Users supplement their natural hair to allow a wider variety of hair styles to be imparted to the user's hair. Additionally, when users are endowed with relatively little hair, the users can supplement their hair to create the impression of a fuller head of hair. Known hair pieces provide for these objectives by attaching a cap that completely covers the natural hair of the user. However, the user may wish to wear a hair accessory to supplement the user's natural hair without covering all of their natural hair.

SUMMARY

A hair accessory is provided. The hair accessory comprises a support structure configured to engage and surround substantially only a rear portion of a user's head, a plurality of hair strand retention members attached to and extending across the support structure, and a plurality of hair strands extending from each of the hair strand retention members.

A support structure for a hair accessory is provided. The support structure comprises a crown segment configured to extend across the crown of the head of a user, the crown segment including a first end and a second end. The support structure further includes at least one central support member which extends substantially perpendicularly from the crown segment between the first and second ends of the crown segment. The support structure further comprises a crossing member configured to extend across the central support members a distance from the crown segment. At least one side segment is configured to extend from the crossing member to a position on the crown segment between the first end of the crown segment and one of the central support members. Another of the side segments is configured to extend from the crossing member to a position on the crown segment between the second end of the crown segment and one of the central support members. The support structure is configured to not engage a portion of a user's head substantially forward of a crown of the user's head.

DETAILED DESCRIPTION

Figure 1:
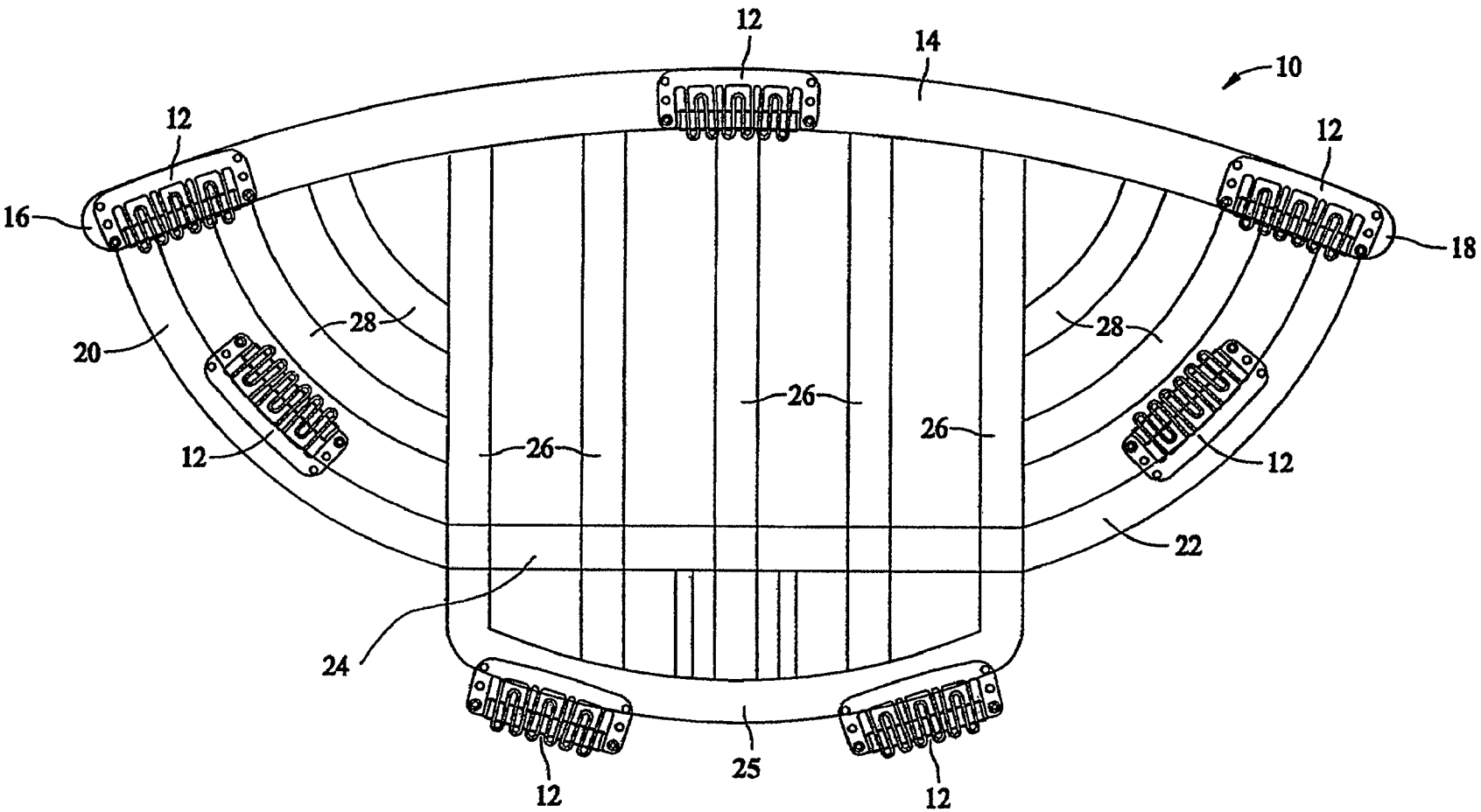
FIG. 1 is an illustration of one embodiment of a support structure for a hair accessory.

FIG. 1 is an illustration of one embodiment of a support structure 10 for a hair accessory (not shown in FIG. 1) which includes a plurality of hair strands (not shown in FIG. 1). Attached to support structure 10 are a plurality of hair engaging members 12, sometimes referred to herein as clips. Support structure 10 includes a plurality of individual segments as described below. In one embodiment, the individual segments are one of elastic and non-elastic. In an alternative embodiment, at least some of the individual segments are elastic and at least some of the individual segments are non-elastic. In certain embodiments, the individual segments are fabricated from a lace, some of which may be elastic, some of which may be non-elastic. In these embodiments, the lace is relatively thin while still providing strength for the attaching of hair strands as described below. In one embodiment, the lace is fabricated from nylon. Utilization of elastic and non-elastic lace allows support structure 10 to retain the shape and contours of the portion of the user's head which support structure 10 is configured to engage.

As further explained below, with regard to an exemplary embodiment, support structure 10 is configured to engage only a rear portion (e.g., the back half) of a user's head, and is sometimes referred to as a half-cap. As such, support structure 10 extends from proximate the crown of a user's head to the base of the user's skull to substantially surround the rear portion of the user's head where hair growth typically occurs. In addition, support structure 10 is configured to not engage the user's head substantially forward of the crown of the user's head.

Support structure 10 is configured to be placed on a user's head to provide the appearance of a full head of hair, or to provide a different hairstyle. More specifically, support structure 10 includes a crown segment 14 configured to extend across the head of a user, substantially near the crown (or "top") of the head. Crown segment 14 includes a first end 16 and a second end 18. Side segments 20 and 22 extend from a position near ends 16 and 18 respectively to a crossing member 24. A bottom segment 25 extends in an arcuate shape from one end of crossing member 24 to another end of crossing member 24. Side segments 20 and 22 extend from crown segment 14 at an angle to crossing member 24 such that crown segment 14, side segments 20 and 22, and bottom segment 25 roughly form an outline that approximates a hair growth pattern typically found on the back (or "rear portion") of a user's head. In one embodiment, crown segment 14, crossing member 24, and bottom segment 25 are not elastic. In certain embodiments, side segments 20 and 22 are divided into sub-portions, certain of which are elastic.

Support structure 10 further includes a plurality of central support members 26 extending substantially perpendicularly from crown segment 14 to crossing member 24 of support structure 10. Side support members 28 extend from crown segment 14 to an outer one of central support members 26 as illustrated. In the illustrated embodiment, central support members 26 and side support members 28 are elastic. While FIG. 1 illustrates five central support members 26 and two side support members 28 on each side of support structure 10, it is to be understood that more or fewer of each could be utilized in other embodiments.

Figure 2:
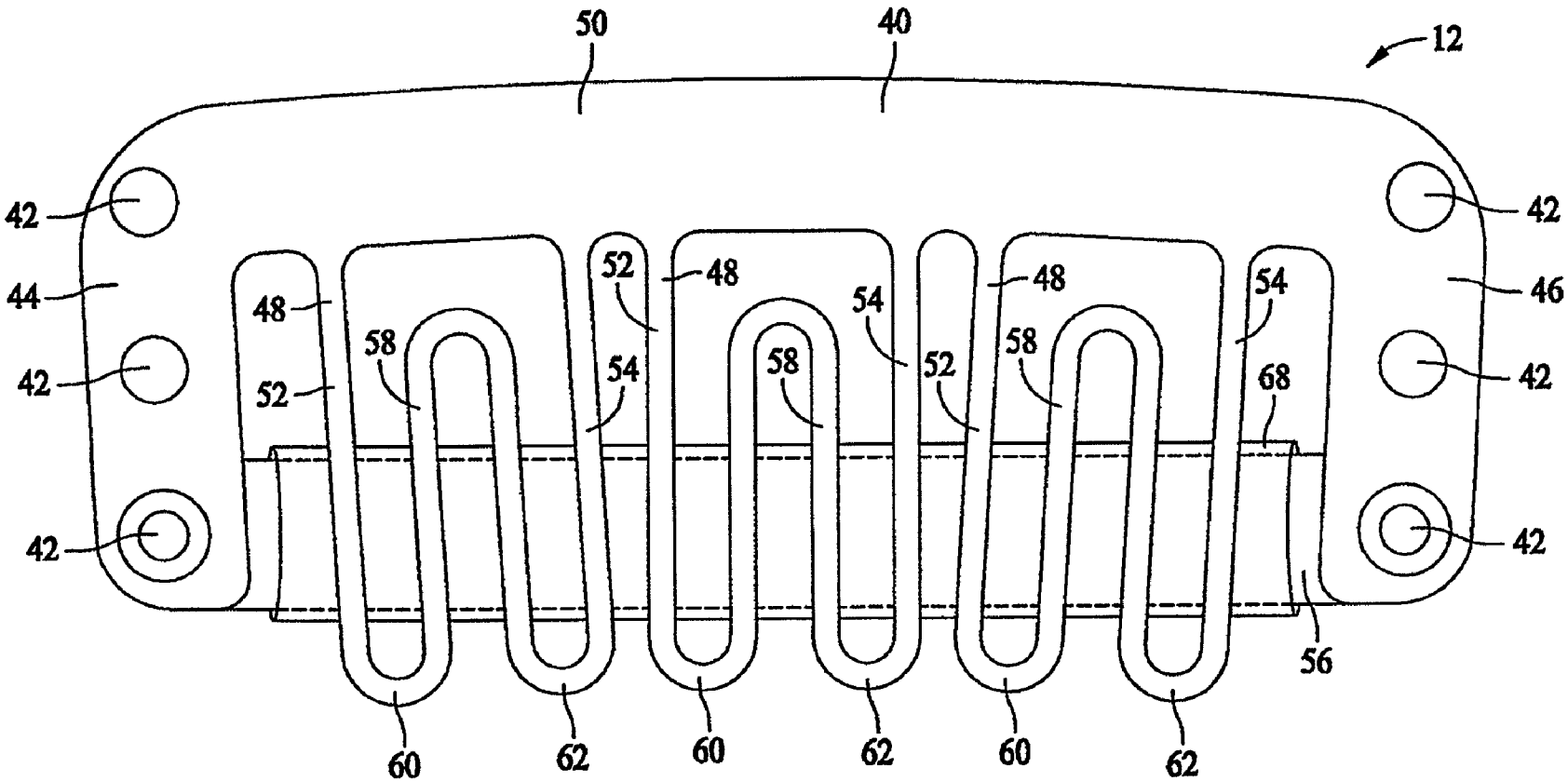
FIG. 2 is an illustration of one of the user hair engaging members attached to the support structure of FIG. 1.

FIG. 2 is a plan view of one hair engaging member 12. The hair engaging member 12 includes a substantially rectangular frame 40 having a plurality of openings 42 formed therethrough. In the embodiment illustrated, openings 42 are formed in a substantially linear pattern within a first end 44 and a second end 46 of rectangular frame 40. Openings 42 may be utilized to stitch, rivet, or otherwise fasten hair engaging members 12 to support structure 10, and because there are a plurality of openings 42, a standard hair engaging member 12 may be coupled to various portions of support structure 10.

For example, one or more of hair engaging members 12 may be stitched to an additional support member (not shown) included within support structure 10 (shown in FIG. 1). Further, such an additional support member may extend between a side segment (20 or 22) and a side support member 28.

The hair engaging member 12 shown in FIG. 2 further includes a plurality of clipping members 48 that extend from a first side 50 of rectangular frame 40. More specifically, each clipping member 48 includes at least a first leg 52 and a second leg 54, each of which extend from first side 50 to overlap a second side 56 of rectangular frame 40. First leg 52 and second leg 54 are joined together by an intermediate section 58 which extends from an end 60 of first leg 52 near second side 56 of rectangular frame 40, towards first side 50 of rectangular frame 40, and back to an end 62 of second leg 54 near second side 56 of rectangular frame 40. As such, the embodiment of each clipping member 48 illustrated in FIG. 2 has a shape somewhat similar to the letter "W". Second side 56 of rectangular frame 40 may be enclosed by a plastic sleeve 68 to which clipping members 48 engage.

Figure 3:
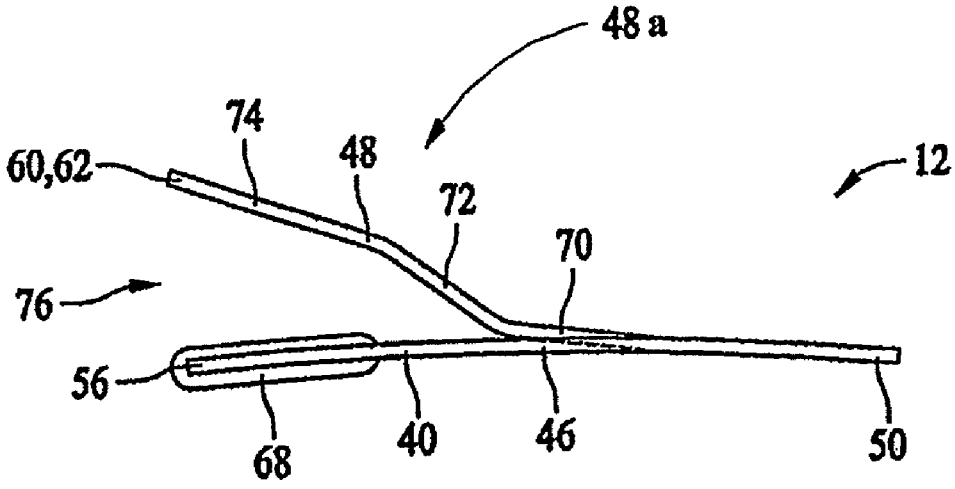
FIG. 3 is an end view of the hair engaging member of FIG. 2 in an open position.
Figure 4:
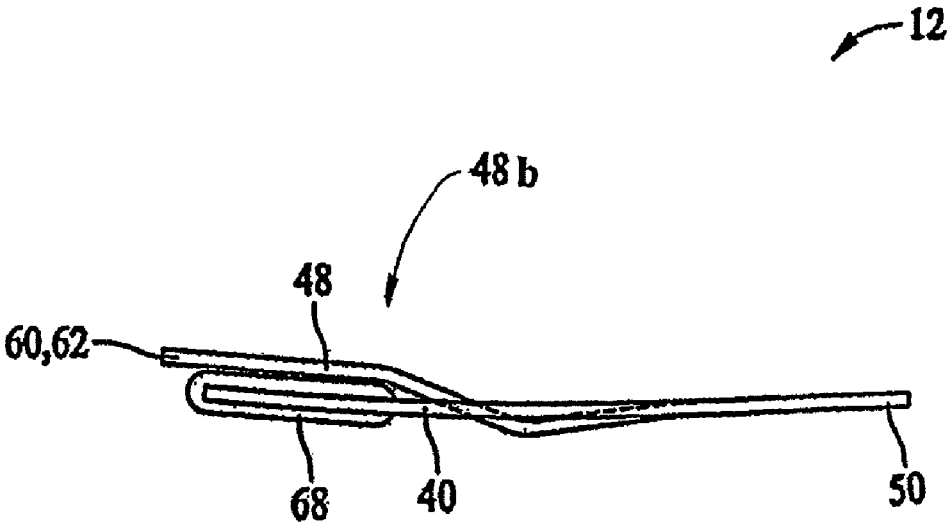
FIG. 4 is an end view of the hair engaging member of FIG. 2 in a closed position.

In one embodiment, hair engaging members 12 are metallic and configured in an arcuate shape such that the clipping members 48 can be changed from an open configuration 48*a* to a closed configuration 48*b*. FIG. 3 is an end view of hair engaging member 12 having clipping members 48 at the open position 48*a*. In the illustrated open position 48*a*, clipping members 48 include three distinct segments: a base segment 70 that extends from first side 50 of rectangular frame 40, a mid segment 72 which extends at an angle from base segment 70, and a hair engaging segment 74 which extends at an angle from mid segment 72. The angled segments of clipping members 48 result in a space 76 between the clipping members 40 and second side 56 of rectangular frame 40. FIG. 3 further shows the relationship of plastic sleeve 68 with ends 60 and 62 of clipping members 48. As further described below, a user inserts their own hair into space 76, and then moves the clipping members 48 to the closed configuration 48*b*, as shown in FIG. 4.

In the closed configuration 48*b*, ends 60 and 62 of clipping members 48 contact plastic sleeve 68. Such a configuration causes any of the user's hair that had been inserted into space 76 to be retained between clipping members 48 and plastic sleeve 68.

Figure 5:
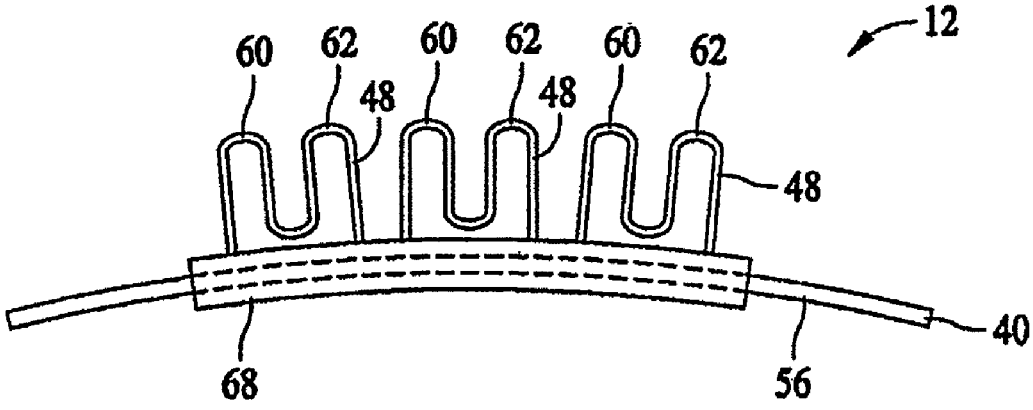
FIG. 5 is a side view of the hair engaging member of FIG. 2 in the open position.

FIG. 5 is a side view of hair engaging member 12 from second side 56 of rectangular frame 40 in the open configuration. As shown in FIG. 5, ends 60 and 62 of clipping members 48 are separated from plastic sleeve 68 resulting in space 76, shown in FIG. 3. In addition, the arcuate shape of rectangular frame 40 is shown.

Figure 6:
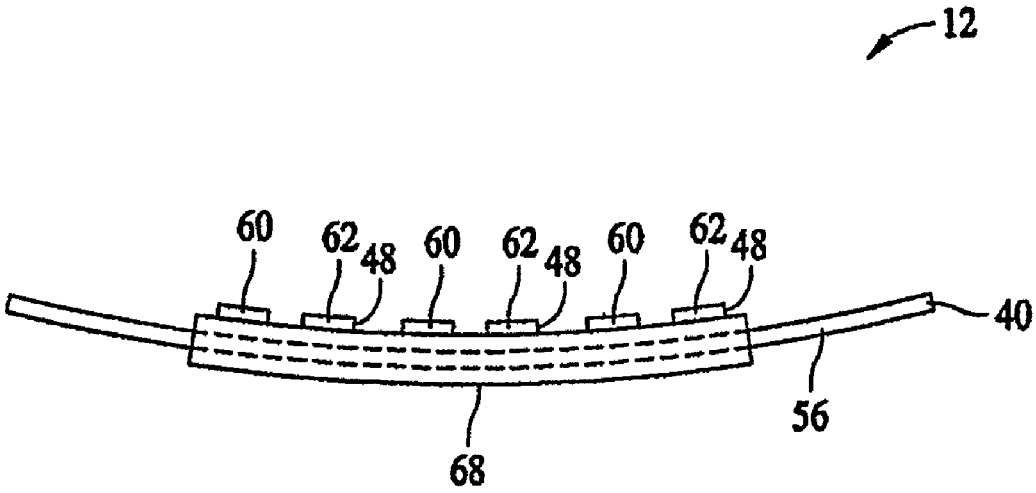
FIG. 6 is a side view of the hair engaging member of FIG. 2 in the closed position.

FIG. 6 is a side view of hair engaging member 12 from second side 56 of rectangular frame 40 in the closed configuration. As shown in FIG. 6, ends 60 and 62 of clipping members 48 engage plastic sleeve 68 which allows retention of clipping members 48, and ultimately retention of support structure 10 within a user's natural hair. Also shown in FIG. 6 is the change in the arcuate shape of rectangular frame 40 of hair engaging member 12 as it is sprung from the open configuration (shown in FIGS. 3 and 5) to the closed configuration (also shown in FIG. 4).

Figure 7:
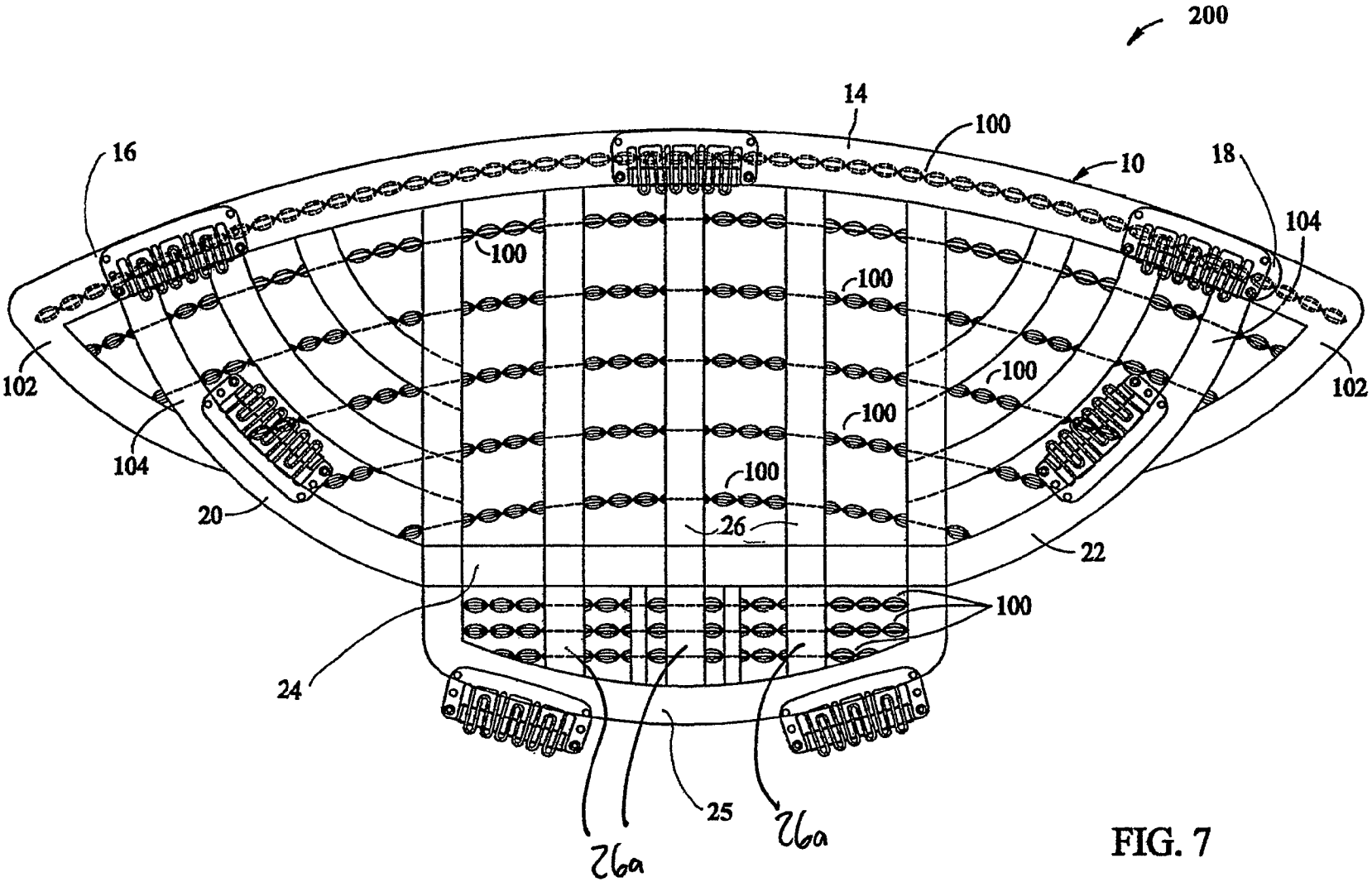
FIG. 7 illustrates hair strand retention members in a relationship with the support structure of FIG. 1.

FIG. 7 illustrates hair strand retention members 100 in a relationship with support structure 10 (also shown in FIG. 1) to form a partial cap hair accessory 200. As illustrated, hair strand retention members 100 are configured in rows that are substantially parallel to one another. Each such row extends across the width of support structure 10 and engages segments of support structure 10, for example, one or more of crown segment 14, side segments 20 and 22, crossing member 24, bottom segment 25 and the plurality of central support members 26. In one embodiment, hair strand retention members 100 are stitched to the segments of support structure 10 that they intersect.

In one embodiment, hair strand retention members 100 are formed utilizing a stitching pattern such that they engage, and retain in place wefts of hair strands inserted into hair strand retention members 100 as a segment of the hair strand retention member 100 manufacturing process. Certain of hair strand retention members 100 are longer than others due to the overall configuration of support structure 10. For example, hair strand retention members 100 which extend across crown segment 14 of support structure 10 are much longer than, for example, hair strand retention members 100 which extend across crossing member 24 and bottom segment 25. In one embodiment, segments of hair strand retention members 100 extend beyond, for example, side segments 20 and 22. In such an embodiment, also shown in FIG. 7, an end connecting member 102, similar to a non elastic portion 104 of side segments 20 and 22, extends across and connects the ends of hair strand retention members 100 that extend beyond support structure 10. As shown in FIG. 7, end connecting members 102 extend between a respective one of side segments 20 and 22 and a respective end 16 and 18 of crown segment 14.

In one embodiment, the crown segment 14 is nonelastic. Hair strand retention members 100 may be coupled to an otherwise elastic crown segment 14 to make the crown segment 14 nonelastic (as shown in FIG. 7), or the crown segment 14 may be constructed of a nonelastic material. The crossing member 24 and the bottom segment 25 according to this embodiment are also nonelastic. Similar to this crown segment 14, this crossing member 24 and bottom segment 25 may be coupled to strand retention members 100 and/or constructed of a nonelastic material. Though not shown in the drawings, the portions 26*a* (FIG. 7) of the central support members 26 that extend between the crossing member 24 and the bottom segment 25 may be removed and replaced with a netting, such as a breathable, nonelastic, honeycomb netting.

The side segments 20, 22, the central support members 26, and the side support member 28 according to this embodiment are constructed of a stretch lace that retains the shape and contours of the wearer's head better than many known foundations. For example, the stretch lace may be fabricated from nylon that includes strands of spandex. Previous lace used in hair accessories typically does not mold to the wearer's head very well and is usually at least ½ of an inch wide. The stretch lace used for the side segments 20, 22, the central support members 26, and the side support member 28 according to this embodiment is approximately ¼ of an inch wide, which is cooler and provides more comfort to the wearer than previous lace used in hair accessories, allows increased conformity to the wearer's head, and provides more shape retention ability. The specific nonelastic portions of this embodiment ensure that the support structure 10 is appropriately positioned about the wearer's head and provide strength to the support structure 10, while the specific elastic portions of this embodiment allow the support structure 10 to comfortably mold to the wearer's head.

Figure 8:
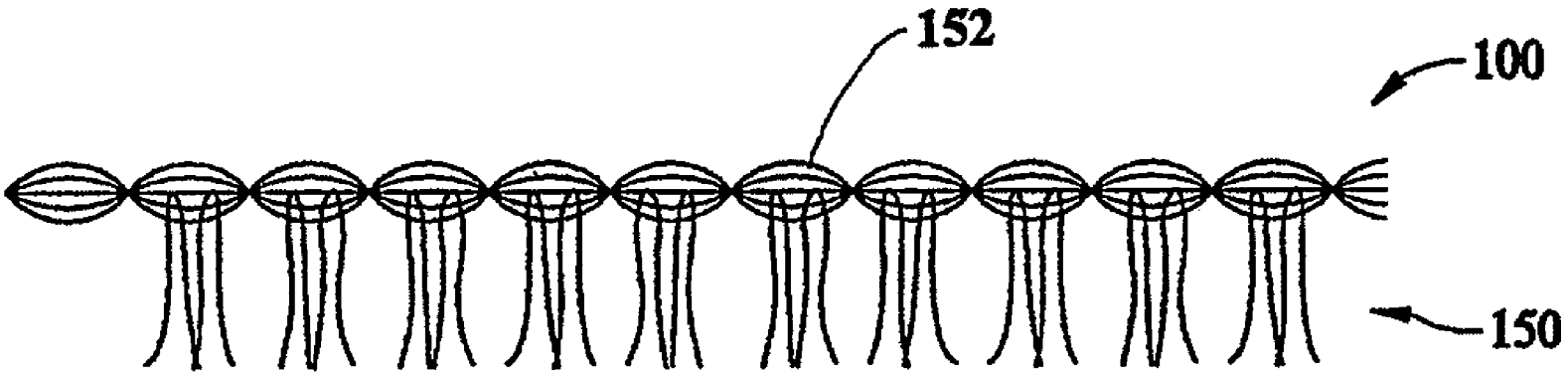
FIG. 8 is an illustration of hair strands attached to one of the hair strand retention members of FIG. 7.

FIG. 8 illustrates one segment of a hair strand retention member 100 that includes hair strands 150 retained therein. For clarity, FIG. 8 illustrates hair strands 150 in a less dense pattern than would be utilized in a typical product. As illustrated, hair strand retention members 100 are formed as a stitched pattern of individual threads 152 that engage a substantial midpoint of hair strands 150. In other words, hair strands 150 are folded approximately in half and the pattern of individual threads 152 engages hair strands 150 at the fold. In one embodiment, hair strands are individually stitched into hair strand retention members 100. In an alternative embodiment, bundles of hair strands 150, ranging from five to 200 individual hair strands per bundle, are stitched into hair strand retention members 100. Spacing between individual hair strands 150, or alternatively, bundles of hair strands 150 is dependent on the density desired for the hair accessory.

Hairs strands 150 may be of any configuration depending on the hair style desired for the finished hair accessory. As a result, a user can utilize the addition of hair strands 150 to the user's natural hair to provide various hair styles, some of which may not be attainable, or desirable in appearance, without the hair accessory 10. More specifically, in various embodiments, hair strands 150 may be arcuate, tightly curled, or substantially straight, and of varying lengths. In addition, hair strands 150 may include one or more of synthetic hair strands or natural hair strands. For synthetic hair strands, the hair may be fabricated from a polymer fiber such as modacrylic, or the synthetic hair may be fabricated from a polymer fiber other than modacrylic, such as, for example, acrylic.

The above embodiments describe a hair accessory which a user may utilize with their own hair to create the impression of a fuller head of hair. However, it should be noted that embodiments may also be utilized by a user with a full head of longer hair that wishes to achieve a shorter hair appearance, or by a user with a full head of shorter hair that wishes to achieve a longer hair appearance.

While the invention has been described in terms of various specific embodiments, those skilled in the art will recognize that the invention can be practiced with modification within the spirit and scope of the claims.

What is claimed is:

1. A hair accessory, comprising:

a support structure configured to engage and surround substantially only a rear portion of a user's head; the support structure comprising:

a crown segment configured to extend across the head of a user, the crown segment comprising a first end and a second end;

a central support member extending substantially perpendicularly from the crown segment between the first and second ends of the crown segment;

a crossing member extending across the central support member a distance from the crown segment; the crossing member not contacting the crown segment;

a first side segment distinct from the crown segment, the first side segment extending directly from the crossing member to a position on the crown segment at one side of the central support member;

a second side segment distinct from the crown segment, the second side segment extending directly from the crossing member to a position on the crown segment at another side of the central support member;

a side support member extending from a point directly touching the crown segment to a point directly touching the central support member; the side support member being inside an area bounded by the first side segment, the central support member, and the crown segment;

a bottom segment extending in an arcuate shape between ends of the crossing member;

a first end connecting member extending from the crown segment and the first side segment; and a second end connecting member extending from the crown segment and the second side segment;

a plurality of hair strand retention members attached to and extending across the support structure; and a plurality of hair strands extending from each of the hair strand retention members.

2. The hair accessory of claim 1, wherein:

the crown segment is nonelastic;

the crossing member is nonelastic; and the bottom segment is nonelastic.

3. The hair accessory of claim 2, wherein:

the at least one central support member is elastic;

the first side segment is elastic;

the second side segment is elastic; and the side support member is elastic.

4. The hair accessory of claim 3, wherein:

the at least one central support member includes stretch lace approximately ¼ of an inch wide;

the first side segment includes stretch lace approximately ¼ of an inch wide; the second side segment includes stretch lace approximately ¼ of an inch wide; and the side support member includes stretch lace approximately ¼ of an inch wide.

5. The hair accessory of claim 4, wherein the plurality of hair strands are stitched individually into the plurality of hair strand retention members.

6. The hair accessory of claim 4, wherein the plurality of hair strands are configured as bundles of individual hair strands, the bundles being stitched into the plurality of hair strand retention members.

7. The hair accessory of claim 4, wherein the plurality of hair strands comprise at least one of natural hair and synthetic hair.

8. The hair accessory of claim 4, wherein said plurality of hair strands are folded, the hair strands being stitched into the plurality of hair strand retention members approximate the fold.

9. The hair accessory of claim 1, wherein the support structure comprises at least one member fabricated utilizing elastic.

10. The hair accessory of claim 1, wherein the plurality of hair strand retention members are configured as substantially parallel rows across the support structure.

11. The hair accessory of claim 1, wherein the support structure is configured to extend from across an area proximate the crown of the user's head rearward and downward along an area of normal hair growth to an area proximate the base of the user's skull.

12. The hair accessory of claim 1, wherein the external perimeter of the support structure is entirely defined by the crown segment, a portion of the first side segment, a portion of the second side segment, the bottom segment, the first end connecting member, and the second end connecting member.

13. The hair accessory of claim 1, wherein the crossing member extends entirely between the first and second ends of the crown segment.

14. A support structure for a hair accessory, the support structure comprising:

a crown segment configured to extend adjacent the crown of the head of a user, the crown segment comprising separate first and second ends;

a central support member extending substantially perpendicularly from the crown segment between the first and second ends of the crown segment;

a crossing member extending across the central support member a distance from the crown segment;

a first side segment distinct from the crown segment, the first side segment extending directly from the crossing member to a position on the crown segment at one side of the central support member;

a second side segment distinct from the crown segment, the second side segment extending directly from the crossing member to a position on the crown segment at another side of the central support member;

a side support member extending from a point directly touching the crown segment to a point directly touching the central support member; the side support member being inside an area bounded by the first side segment, the central support member, and the crown segment;

a bottom segment extending in an arcuate shape between ends of the crossing member;

a first end connecting member extending from the crown segment and the first side segment; and a second end connecting member extending from the crown segment and the second side segment;

wherein the support structure is configured to not engage a portion of a user's head substantially forward of the crown of the user's head.

15. The support structure of claim 14, wherein the external perimeter of the support structure is entirely defined by the crown segment, a portion of the first side segment, a portion of the second side segment, the bottom segment, the first end connecting member, and the second end connecting member.

16. The support structure of claim 14, wherein the support structure is configured to extend from across an area proximate the crown of the user's head rearward and downward along an area of normal hair growth to an area proximate the base of the user's skull.

17. A hair accessory, comprising:

a support structure configured to engage and surround substantially only a rear portion of a user's head; the support structure comprising:

a crown segment configured to extend across the head of a user, the crown segment comprising a first end and a second end;

a first central support member contacting the crown segment between the first and second ends of the crown segment and extending from the crown segment;

a second central support member contacting the crown segment between the first and second ends of the crown segment and extending from the crown segment; the first and second central support members being substantially mirror images of one another about an imaginary centerline of the support structure;

a crossing member extending across the first and second central support members; the crossing member not contacting the crown segment;

a first side segment distinct from the crown segment; the first side segment extending directly from the crossing member to a position on the crown segment at one side of the first and second central support members;

a second side segment distinct from the crown segment; the second side segment extending directly from the crossing member to a position on the crown segment at another side of the first and second central support members; the first and second side segments being substantially mirror images of one another about the imaginary centerline of the support structure;

a first side support member extending from a point directly touching the crown segment to a point directly touching the first central support member; the first side support member being inside an area bounded by the first side segment, the first central support member, and the crown segment;

a second side support member extending from a point directly touching the crown segment to a point directly touching the second central support member; the second side support member being inside an area bounded by the second side segment, the second central support member, and the crown segment;

a bottom segment extending in an arcuate shape between ends of the crossing member;

a first end connecting member extending from the crown segment and the first side segment; and a second end connecting member extending from the crown segment and the second side segment;

a plurality of hair strand retention members attached to and extending across the support structure; and a plurality of hair strands extending from each of the hair strand retention members.

18. The hair accessory of claim 17, wherein the external perimeter of the support structure is entirely defined by the crown segment, a portion of the first side segment, a portion of the second side segment, the bottom segment, the first end connecting member, and the second end connecting member.

19. The hair accessory of claim 18, wherein the crossing member extends entirely between the first and second ends of the crown segment.

20. The hair accessory of claim 19, wherein:

the support structure is configured to extend from across an area proximate the crown of the user's head rearward and downward along an area of normal hair growth to an area proximate the base of the user's skull; and the first and second side support members are substantially mirror images of one another about the imaginary centerline of the support structure.

21. The hair accessory of claim 20, wherein the plurality of hair strand retention members are configured as substantially parallel rows across the support structure.

22. The hair accessory of claim 21, wherein:

the crown segment is nonelastic;

the crossing member is nonelastic;

the bottom segment is nonelastic;

the at least one central support member is elastic;

the first side segment is elastic;

the second side segment is elastic; and the side support member is elastic.

23. The hair accessory of claim 17, wherein the plurality of hair strand retention members are configured as substantially parallel rows across the support structure.

24. The hair accessory of claim 17, wherein:

the crown segment is nonelastic;

the crossing member is nonelastic;

the bottom segment is nonelastic;

the at least one central support member is elastic;

the first side segment is elastic;

the second side segment is elastic; and the side support member is elastic.

25. The hair accessory of claim 17, wherein the first and second side support members are substantially mirror images of one another about the imaginary centerline of the support structure.

* * * * *